US005141049A

United States Patent [19]

Larsen et al.

[11] Patent Number: 5,141,049

[45] Date of Patent: Aug. 25, 1992

[54] TREATMENT OF HEAT EXCHANGERS TO REDUCE CORROSION AND BY-PRODUCT REACTIONS

[75] Inventors: Thomas L. Larsen, Andover; Max E. Underwood, Bedford; Maarten P. Noordzij; Shiou-Shan Chen, both of Winchester, all of Mass.

[73] Assignee: The Badger Company, Inc., Cambridge, Mass.

[21] Appl. No.: 565,048

[22] Filed: Aug. 9, 1990

[51] Int. Cl.[5] ..... F28F 19/00

[52] U.S. Cl. ..... 165/133; 165/158

[58] Field of Search ..... 165/133, 134.1, 158

[56] References Cited

U.S. PATENT DOCUMENTS

| | | | |
|---|---|---|---|
| 3,739,710 | 6/1973 | Costa et al. | 99/348 |
| 4,081,193 | 4/1978 | Salminen | 34/41 |
| 4,436,146 | 3/1984 | Smolarek | 165/111 |

FOREIGN PATENT DOCUMENTS

| | | | |
|---|---|---|---|
| 60-36895 | 2/1985 | Japan | 165/133 |
| 60-129600 | 7/1985 | Japan | 165/133 |

*Primary Examiner*—Allen J. Flanigan

*Attorney, Agent, or Firm*—Pandiscio & Pandiscio

[57] ABSTRACT

The invention provides a method of extending the useful life of high temperature heat exchangers, e.g., reactor feed/effluent heat exchangers, in installations where the heat exchanger is contacted by a process fluid stream, e.g., a feedstock comprising ethylbenzene, at a temperature where the process stream may cause deterioration of contacted metal surfaces of the heat exchanger and/or undergo catalytic reaction as a result of contact with the contacted metal surfaces. The new method comprises the step of mechanically removing material from those surfaces of the heat exchanger that are to be contacted by the process fluid stream, so as to render said surfaces less susceptible to attack from said high temperature process fluid stream.

12 Claims, 2 Drawing Sheets

TREATMENT OF HEAT EXCHANGERS TO REDUCE CORROSION AND BY-PRODUCT REACTIONS

Figure 1:
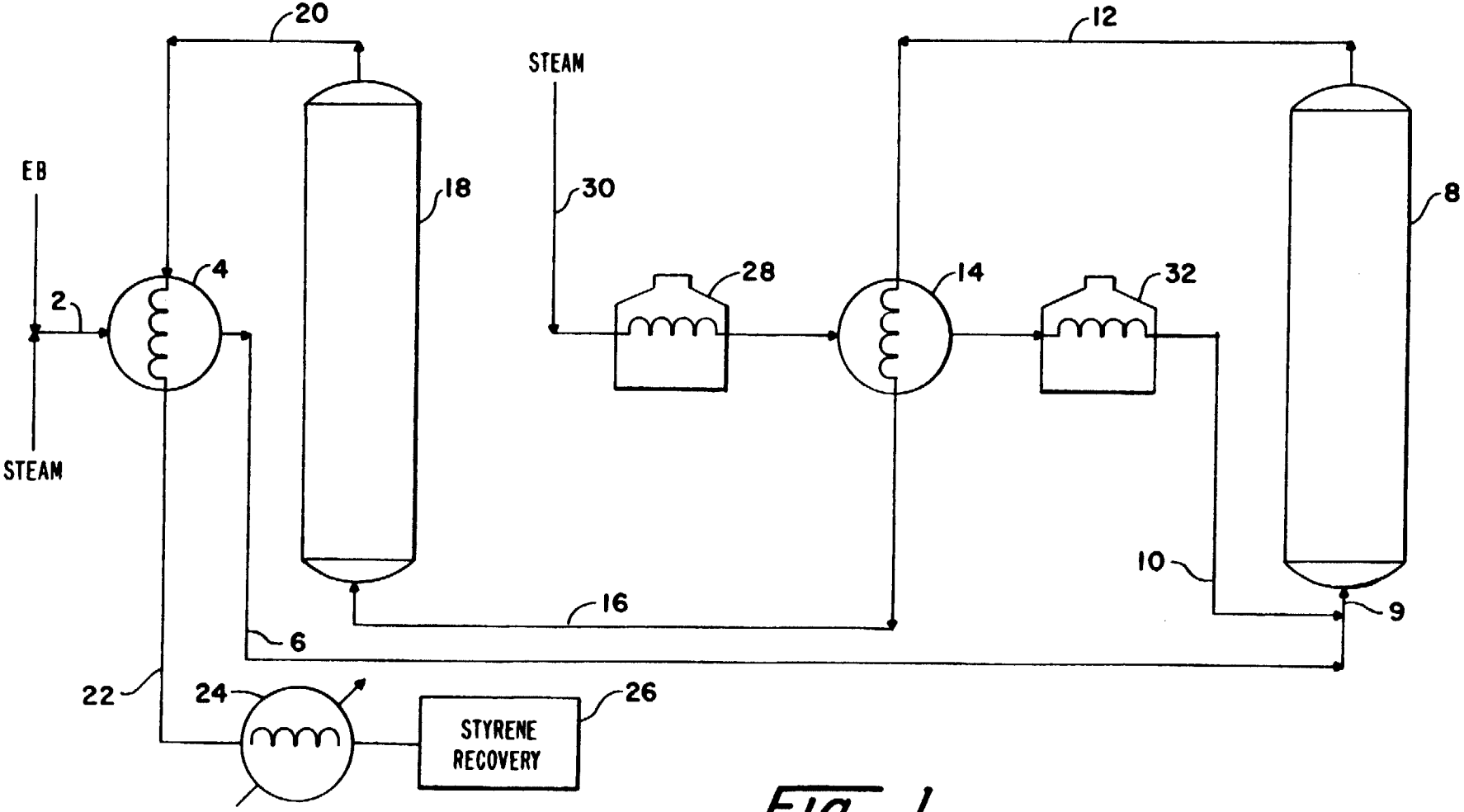

This application relates to extension of the useful life of high temperature shell and tube heat exchangers (also known as "sheet and tube heat exchangers") in chemical plants, e.g., plants for manufacturing styrene.

PRIOR ART

In many petrochemical plants, e.g., plants for the manufacture of styrene, a feedstock is heated by indirect heat exchange with the hot effluent from one or more reactor stage(s). In such installations where the operating temperature of the reactor stage(s) is relatively high, e.g., about 1000 degrees F., it is customary to use a shell and tube type heat exchanger to heat the feed by means of heat recovered from the reactor effluent, with the heat recovery involving passing the reactor effluent through the tubes of the heat exchanger, and passing the feedstock through the shell, i.e., outside the tubes, of the same heat exchanger. Such a heat exchanger is often termed a "reactor feed/effluent heat exchanger".

Unfortunately, depending upon temperature and the reaction system, i.e., the primary chemical process, a process fluid stream such as a feedstock may tend to interact with any metal surfaces that it contacts, thereby causing accelerated deterioration of those metal surfaces and possible production of unwanted by-products. By way of example, but not limitation, in a dehydrogenation plant for manufacturing styrene from ethylbenzene ("EB") the primary reactants are EB and steam, and typically the reactor effluent is cooled by passing it through a styrene reactor feed/effluent heat exchanger where it exchanges heat with the vapor and/or liquid state feed (EB, or EB and water) for the dehydrogenation reactor(s). It is common for the reactor feed/effluent heat exchanger to be a shell and tube type heat exchanger, with the feed stream (typically steam and a hydrocarbon mixture rich in EB) passing through the shell around the tubes (i.e., the shell side) and the reactor effluent stream flowing inside the tubes (i.e., the tube side). Under various abnormal operating conditions, the feed stream tends to interact with the outside metal surfaces of the exchanger tubes to simultaneously cause corrosion damage to the tubes and accelerated (catalyzed) decomposition of some of the hydrocarbons in the feed stream, causing some of the hydrocarbons in the feed stream to be converted to carbon, coke and various gaseous by-products. The interaction of the feed stream and the metal surfaces of the tubes of the reactor feed/effluent heat exchanger causes formation of carbon and various gases, and the attendant metal damage caused by such interaction can result, and has resulted, in premature and total failure of the reactor feed/effluent heat exchanger.

The failure of a heat exchanger in a chemical plant is always costly, and such cost is always greater in the case of premature or unexpected failure. What is even more costly is the loss of a reactor feed/effluent heat exchanger in a large chemical plant such as a styrene plant, since (a) the plant cannot operate without the reactor feed/effluent heat exchanger, (b) the cost of replacing a reactor feed/effluent heat exchanger can be very high, and (c) the time required to replace the reactor feed/effluent heat exchanger is in the order of weeks, even if a replacement reactor feed/effluent heat exchanger is available immediately upon notice of failure of the existing heat exchanger.

SUMMARY OF THE INVENTION

The primary object of this invention is to extend the useful life of high temperature heat exchangers, in installations where the heat exchanger is contacted by a process fluid stream at a temperature where one or more components of the process stream may cause deterioration of contacted metal surfaces of the heat exchanger and/or undergo catalytic reaction as a result of contact with those contacted metal surfaces, e.g., a reactor feed/effluent heat exchanger in a styrene plant.

Another object of this invention is to materially reduce economic losses incurred by a chemical process plant shutdown caused by deterioration of one or more high temperature heat exchangers as a result of attack by a process fluid stream.

Still another object of this invention is to provide a method of increasing the useful life of a shell and tube heat exchanger used in a high temperature corrosive environment, comprising the step of mechanically removing material from selected surfaces of the heat exchanger that are to be contacted by a high temperature process fluid stream, so as to render said surfaces less susceptible to attack from said stream.

Still another object is to reduce the tendency of metal surfaces to carburize at high temperatures, e.g., temperatures in the order of 1000 degrees F. or higher, in the presence of a hydrocarbon process stream.

A further object is to reduce the rate of formation of coke in an reactor feed/effluent heat exchanger in a styrene plant.

Still another object is to reduce the rate of formation of by-product deposits in reactor feed/effluent heat exchangers in styrene plants.

A further object of this invention is to provide a method of treating the surfaces of tubes of reactor feed/effluent shell and tube heat exchangers to reduce corrosion and by-product hydrocarbon reactions.

Still other objects and features of this invention are described or rendered obvious by the following detailed description of a preferred embodiment of the invention and possible modifications, which description is to be considered together with the accompanying drawing that is described hereinafter.

THE DRAWING

Figure 2:
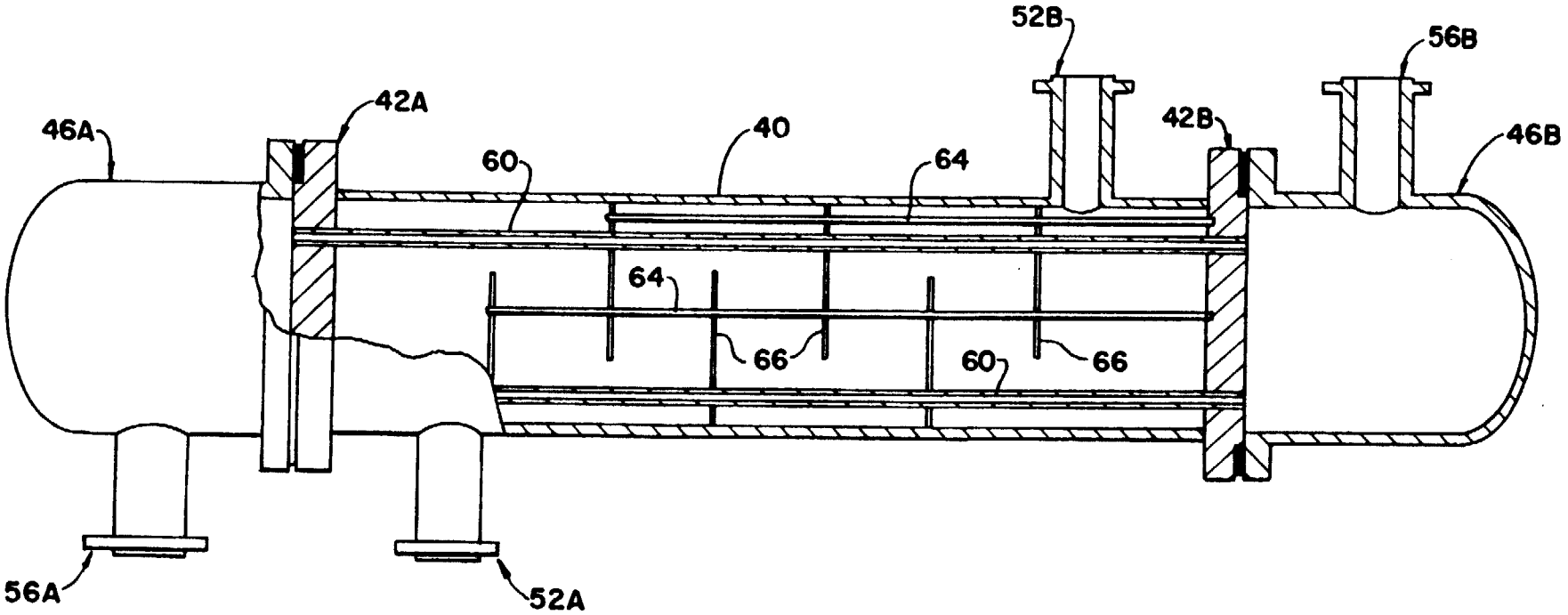

FIG. 1 schematically illustrates a styrene plant embodying the present invention; and FIG. 2 schematically illustrates a conventional shell and tube heat exchanger.

PREFERRED EMBODIMENT OF THE INVENTION

The invention is described in detail hereinafter in relation to its application in a process for the dehydrogenation of ethylbenzene (EB) to styrene, but it is to be understood that it has other applications, many of which will be obvious to persons skilled in the art.

In typical ethylbenzene dehydrogenation processes known prior to the present invention, (see, for example, U.S. Pat. Nos. 2,831,907, 3,223,743, 3,847,968, 44,779,025, and 4,695,664, and the references cited therein, all of which are incorporated herein by reference thereto) an ethylbenzene-rich feedstock and steam are fed to a dehydrogenation reactor where the EB is dehydrogenation in the presence of the steam and a dehydrogenation catalyst so as to form styrene. In addition to EB, the feedstock typically may comprise other $C_1$-$C_9$ hydrocarbons, such as carbon monoxide, carbon dioxide, methane, ethane, butane, propane, benzene, toluene, cumene and one or more of the possible xylenes. The dehydrogenation reaction effluent is usually above 1000 degrees F. and comprises unreacted EB, product styrene, steam, unreacted $C_1$-$C_9$ hydrocarbons and various light gases and hydrocarbon by-products, including but not limited to benzene, toluene, hydrogen, carbon monoxide, carbon dioxide, and methane. The effluent stream from the last reactor stage is desuperheated by indirect heat exchange in one or more heat exchangers. Thereafter, the still vapor-phase effluent stream is further cooled and condensed in a condenser to produce a mixed-phase effluent stream. The latter is then treated according to well-known techniques to separate the vapor and liquid phases. Styrene and water are separately recovered from the liquid phase, and the vapor phase is recovered for fuel or other uses.

FIG. 1 relates to prior art and illustrates a conventional styrene manufacturing plant employing dual reactors. In this case, steam and a mixed hydrocarbon feedstock rich in EB are fed to a line 2 that is connected so as to pass the steam/hydrocarbon feed through a reactor feed/effluent heat exchanger in the form of a high temperature shell and tube heat exchanger 4. The heated feed mixture in line 6 and high temperature steam supplied via a line 10 are passed to a first dehydrogenation reactor 8 via a line 9. Reactor 8 contains a selected dehydrogenation catalyst, e.g., a catalyst of the kind described in the aforementioned U.S. patents. The additional steam supplied via line 10 increases the steam to hydrocarbon ratio in the feed mixture while simultaneously heating it to a higher temperature calculated to promote the dehydrogenation reaction in reactor 8. In reactor 8 a major portion of the EB undergoes catalytic dehydrogenation so as form styrene. The effluent from reactor 8 passes via a line 12 through a heater in the form of a heat exchanger 14 before passing via line 16 into a second dehydrogenation reactor 18 where a substantial portion of the remaining EB content of the feed mixture is dehydrogenated to styrene. Reactor 18 also contains a dehydrogenation catalyst. The effluent from reactor 18 passes via a line 20 through the reactor feed-/effluent heat exchanger 4 where it is desuperheated. The desuperheated effluent passes from exchanger 4 via a line 22 through a condenser 24 where it is cooled sufficiently to condense the styrene and steam. The condensed effluent is then passed to a recovery stage 26 where liquid styrene is recovered in accordance with well-known techniques.

High temperature steam is produced by passing low temperature steam through a furnace 28 via a line 30. The high temperature steam from furnace 28 passes through heater 14 to raise the temperature of the effluent in line 12 to a level adequate for the dehydrogenation reaction in reactor 18. The heat loss suffered by the high temperature steam in heating the effluent in line 12 is made up by passing the steam through a second furnace 32. That high temperature steam then passes via line 10 into reactor 8.

It is to be noted that the reaction effluent in line 20 passes through the interior of the tubes of reactor feed-/effluent heat exchanger 4, while the feed mixture passes outside of those tubes.

Because the dehydrogenation reaction of selected hydrocarbon materials is favorably influenced by a decrease in pressure, many commercial hydrocarbon dehydrogenation processes, e.g. dehydrogenation of EB, are conducted at a relatively low pressure, usually below about one and one half atmospheres, in order to achieve satisfactory hydrocarbon conversion. Operating within that pressure range, dehydrogenation conditions in general for ethylbenzene (and homologs and analogs thereof) have included a reaction temperature in the reactor(s) in the range of about 950 degrees F. to approximately 1300 degrees F., preferably between about 1000 and about 1200 degrees F., and an average pressure within the dehydrogenation reactor(s) ranging from about 300 mm Hg to about 1200 mm Hg absolute. The operating pressure within the dehydrogenation reactor(s) is measured at the inlet, midsection and outlet section of the reactor(s) to thereby provide an appropriate average pressure. More specifically, the reaction effluent is usually between about 1000 and 1200 degrees F. and comprises styrene product, unreacted EB, steam, unreacted hydrocarbons, and light gaseous by-products. The effluent stream is desuperheated by indirect heat exchange to usually between 200 and 400 degrees F. in one or more heat exchangers. Thereafter, the still vapor-phase effluent stream is further cooled and condensed in a condenser to a temperature of between about 80 and 130 degrees F. to produce a mixed-phase effluent stream. Subsequent treatment using well-known techniques separates the vapor and liquid phases. Styrene and water are separately recovered from the liquid phase, while the vapor phase, typically comprising low molecular weight hydrocarbons such as CO and methane, is recovered for fuel or other uses.

Commercial styrene plants also tend to be operated with a ratio of steam to ethylbenzene or other alkylaromatic feedstock in the feed line 9 leading to the reactors ranging from about 0.6 lbs. to about 3.0 lbs. of steam per pound of EB, or a ratio of between about 3.5:1 to 18:1 on a mole basis.

Dehydrogenation conditions as set forth above have been considered in evaluating the problem of heat exchanger life and product yield and also the advantages of the present invention, and such dehydrogenation conditions are applicable to the practicing of the present invention.

The heat exchangers used in high temperature hydrocarbon conversion installations, e.g., as feedstock superheaters in plants for converting EB to styrene, may be made of various materials, including 300 series stainless steels (e.g., Type 304H stainless steel), higher content nickel alloys such as Incoloy 800 or Incoloy 800H, and low chrome iron alloys that are substantially free of nickel, e.g., chrome alloys containing about 2.5 wt % chromium and about 1.0 wt % molybdenum. Generally all of the components of the heat exchanger are made of the same material, so to achieve thermal expansion compatibility. The choice of stainless steel may vary, but typically Type 304H stainless steel is preferred. All of the stainless steels used in high temperature heat exchangers contain chromium. More specifically Series 300 stainless steels typically have a nominal content of about 18 wt % chromium and about 8 wt % nickel.

Regardless of whether the exchanger is made of stainless steel or a selected chromium alloy, the chromium content serves to provide a surface that is corrosion resistant and also relatively inert relative to hydrocarbons. Chromium readily oxidizes to chromium oxide on exposure to air, and that oxide provides an inert surface.

In the conception of this invention, several facts were noted with respect to conventional styrene processes as described above. For one thing, as shown schematically in FIG. 1, the typical arrangement calls for the effluent from the reactor(s) to pass through the interior of the tubes of the reactor feed/effluent heat exchanger 4, while the feed mixture passes outside of those tubes. For a second thing, it was discovered that failure of shell and tube type reactor feed/effluent heat exchangers in styrene plants is due to a corrosion process that appears to involve the formation of coke and/or other carbonaceous deposits in the spaces between the shell and tubes, with those deposits deforming and cracking the tubes and thereby causing ultimate failure of the heat exchanger. For a third thing, the corrosion process occurs in heat exchangers made of stainless steel, higher content nickel alloys such as Incoloy 800 or Incoloy 800H, and low chrome iron alloys that are substantially free of nickel, e.g., chrome alloys containing about 2.5 wt % chromium and about 1.0 wt % molybdenum.

It is believed that the formation of coke is preceded by the presence or formation of carbon monoxide which attacks exposed heat exchanger surfaces and gives up carbon to the metal, effectively carburizing the metal so as to promote formation of carbides. It this connection it is to be noted that it not unusual for the EB-rich feedstock to contain carbon monoxide and methane, and also that carbon monoxide may be formed by decomposition of $C_1$–$C_9$ hydrocarbons in the dehydrogenation reaction environment.

Also it is believed that metal or metal-containing carbide particles are exposed by the carburization process, and that those particles are brittle and tend to separate from the tubes. The exposed and separated or released metal and/or metal-containing particles serve as catalysts to cause reformation of the hydrocarbons in hydrocarbon/ steam feed mixture, thereby producing coke and/or other undesired hydrocarbon by-products. The coke (and possibly some of the other undesired hydrocarbon by-products) tend to deposit on adjacent surfaces of the heat exchanger, and ultimately the deposits become massive enough to deform and crack the tubes and/or promote or cause corrosion failure of the tubes. The tendency to form coke or other carbonaceous deposit tends to be greatest in those areas which are hottest and where the residence time is relatively high.

In considering this invention, attention should be paid to the fact that the weight or mole ratio of steam to hydrocarbons in the reactor effluent in a styrene plant is much greater than the ratio of steam to EB in the feed stream to the reactor feed/effluent exchanger. The ratio in the feed stream in line 2 is typically about 1.5:1 on a mol basis, whereas the ratio in line 9 as noted earlier ranges from about 3.5:1 to about 18:1. The high ratio of steam to hydrocarbons in the reactor effluent tends to reduce corrosion of the inside surfaces of the tubes of the feed/effluent heat exchanger, since the relatively high concentration of oxygen presented by the steam offsets any tendency of the hydrocarbons to attack the metal surfaces of the heat exchanger. On the other hand, the much lower ratio of steam to hydrocarbons in the feedstock in line 2 tends to permit or promote corrosion of the feed/effluent heat exchanger. In this connection it is to be appreciated, as noted previously, that in the usual commercial styrene plant the reactor effluent passes inside of the tubes of the reactor feed/effluent heat exchanger while the feedstock passes outside and around those tubes, i.e., the feedstock flows through the shell side of the heat exchanger. It is possible also that the relatively greater residence time of the gas stream on the shell side of the heat exchanger may contribute to the corrosion process.

In the conception of this invention, it was discovered also that the premature failure of high temperature shell and tube heat exchangers, except those made of low chrome iron alloys, due to attack by a process fluid stream did not appear to involve the tubesheet or header portions of the heat exchanger, but instead appeared to be due primarily to failure of the tubes. Further examination revealed that in a typical styrene plant, the tendency of those tubes to fail was greatest where the feedstock temperature was greatest. It was discovered further that coke and metal corrosion tended to occur more readily in the region where the tubes were hottest, particularly in crevices such as at the junction of the tubes with the tubesheets or baffles, and that coke formation and metal corrosion tended to be much less evident at the surfaces of the tubesheets. It was noted that in the case where the heat exchanger extends vertically, the corrosion tends to occur mostly at the upper (hotter) end of the exchanger. Based on the foregoing facts, it was theorized that the corrosion and by-product reactions occur at a much lower rate on the tubesheets because those parts have been machined or ground, and hence have a lower concentration of surface defects or impurities than the tubes.

Of significance, in this regard, is the fact that the surfaces of the tubesheets and associated header components of shell and tube heat exchangers are generally machined or ground to a smooth surface and, therefore, they have few, if any, surface blemishes or impurities that are more readily corroded by the reactants or reaction by-products and/or can serve as catalytic sites. In contrast, the tubes of those heat exchangers generally are made by a drawing process followed by heat treatment, and normally those tubes are installed in the heat exchangers without any further surface treatment, except for possibly acid pickling. Hence the tubes are installed in the heat exchanger in substantially the same condition as they are when made, except for any impurities picked up after manufacture.

Accordingly, the primary basis and focus of this invention is to provide a high temperature heat exchanger with surfaces that have been treated so as to have a reduced tendency to react at relatively high temperatures with a fluid hydrocarbon stream, thereby avoiding premature failure of the heat exchanger due to corrosion caused by contact and catalytic reaction with a fluid hydrocarbon stream and undesired hydrocarbon by-products.

It has been determined that the problem of premature corrosion failure of high temperature heat exchangers, e.g., heat exchangers subjected to temperatures of 900 degrees F. or higher, may be avoided, or at least drastically reduced, if all of the exterior surfaces of the tubes of the high temperature shell and tube heat exchangers used in such processes are subjected to mechanical reformation so as to eliminate the existence of corrosion sites on those surfaces. In this connection, it is to be noted that physical or crystallographic defects and impurities on the surfaces of a shell and tube reactor feed/effluent heat exchanger tend to serve as sites to promote a catalytic reaction between the chemical components of the heat exchanger and the hydrocarbon process stream. According to the theory of this invention, the higher the number of surface defects and sites of impurities, the greater the rate of corrosion and the more likely the occurrence of catalytic by-product reactions.

Therefore, as a result of the consideration given to the condition of high temperature heat exchangers that have undergone premature failure, it has been determined by experimentation that, at least for those heat exchangers made of stainless steel or a higher nickel alloy such a Incoloy 800 or 800H, the tendency of the exterior surfaces of the tubes of a shell and tube heat exchanger to react with a process fluid stream may be reduced if those exterior surfaces are mechanically modified by grinding, machining or other surface-altering treatment, so as to present a substantially virgin surface exposed to oxygen and other gases, e.g., nitrogen, whereby the modified surfaces are more resistant to corrosion and do not provide any catalytic sites that will promote reformation of a hydrocarbon process fluid stream. Of course, the surface-altering treatment is accomplished on the components of the heat exchanger before the latter is assembled. In other words, fabrication of the various components of the heat exchanger includes a surface altering treatment as described herein.

It is to be noted that this treatment does not appear to improve the corrosion resistance of heat exchangers made of chrome iron alloys that contain no nickel, e.g., alloys containing about 2.5 wt % chromium and about 1.0 wt % molybdenum.

Referring now to FIG. 2, the illustrated apparatus is a conventional shell and tube heat exchanger of the kind to which this invention pertains. The illustrated apparatus comprises a hollow vessel or shell 40 that is terminated by a pair of tubesheets 42A and 42B attached to its opposite ends, and a pair of stationary hollow heads 46A and 46B attached to vessel 40 via tubesheets 42A and 42B. Vessel or shell 40 has a pair of shell nozzles or ports 52A and 52B, while heads 46A and 46B have tube or channel nozzles 56A and 56B. Extending within vessel 40 is a plurality of hollow tubes 60, each having its opposite ends mounted to tube sheets 42A and 42B. Tubes 60 communicate with the interiors of hollow heads 46A and 46B. The exchanger may also comprise a plurality of tie rods 64 that have one end anchored in either of tubesheets 42A and 42B. The shell nozzles 52A and 52B serve to circulate a fluid inside vessel 40 around tubes 60. A plurality of transverse baffles or support plates 66 attached to tie rods 64 may be used to provide support for the tubes, without impeding flow of fluid through the vessel between shell nozzles 52A and 52B.

In the conventionally made heat exchanger, the tubes 60 are formed by a drawing process, while the tubesheets 42A and 42B are formed from rolled plates or forgings that are mechanically processed, i.e., machined or ground to specifications. The baffles 66, hollow heads 46A and 46B, and shell 40 may be made from rolled plates that may or may not have been machined or ground before installation. The tie rods 64 are commonly made by a drawing process, and hence, for the purposes of this invention, they may (but need not) be treated similarly to tubes 23.

According to this invention, all surfaces of the heat exchanger that tend to corrode and fail as explained above must be subjected to machining or grinding so as to eliminate any catalytic sites or any other surface blemishes, aberrations or impurities that would tend to promote hydrocarbon catalytic reactions and/or corrosion as a result of contact of those surfaces by the corrosive process stream.

Thus, referring again to FIG. 2, the exterior surfaces of tubes 60, the surfaces of baffles 66, and the surface of the hottest one of the two tubesheets 42A, 42B that faces the interior of shell 40 are all machined or ground so as to cold work those surfaces and also to eliminate surface blemishes, aberrations or impurities that tend to act as catalytic or corrosion sites. Optionally the surfaces of tie rods 64 may also be machined or ground.

In the practice of this invention, it is contemplated that the feedstock in a plant for the manufacture of styrene from ethylbenzene (EB), the water(steam)/EB feedstock mixture will be superheated by passing the same through the shell side of a shell and tube heat exchanger, and all of the surfaces of the shell and tube heat exchanger that tend to corrode when exposed to the feedstock mixture will have been machined or ground to a microfinish calculated to eliminate all blemishes and also to cold-work said exterior surfaces so as to render more fine the crystal grain of said surfaces.

EXAMPLE

By way of example, but not limitation, the invention is applicable to a styrene manufacturing process as shown in FIG. 1 where effluent leaves dehydrogenation reactor 8 at a temperature of about 1000 to 1050 degrees F. and is heated to a temperature of about 1125 to 1200 degrees F. in reheater 14 before passing into dehydrogenation reactor 18. The effluent from reactor 18 is at a temperature of about 1050 to 1125 degrees F. and a pressure of about 6 to 15 psia when it passes to the reactor feed/effluent heat exchanger 4, where it is cooled to a temperature of about 500–800 degrees F. The EB/steam feed mixture has a temperature of about 150–300 degrees F. when it enters the reactor feed/effluent heat exchanger 4, and has a temperature of about 950–1050 degrees F. when it passes from the superheater into line 6. The additional steam fed by line 10 causes the EB/steam mixture to have a temperature of about 1125–1200 degrees F. when it enters reactor 8.

The present invention offers the advantages that it does not require any modification of the geometry or material of composition of conventional reactor feed-/effluent exchangers, and may be practiced using well-known equipment and techniques. A further advantage is that the cost of machining or grinding the tubes and other related components of a reactor feed/effluent heat exchanger is small in relation to the cost advantage of substantially extending the useful life of reactor feed/effluent heat exchangers. Still another advantage is that the invention is applicable to various forms of shell and fuse heat exchangers, e.g., exchangers without baffles 66 or exchangers with other components in addition to those shown in FIG. 2.

Obviously the invention is not limited to extending the life of reactor feed/effluent heat exchangers for styrene plants. Thus the invention has application to high temperature heat exchangers used in dehydrogenation reactions involving analogs or homologs of ethylbenzene, e.g., the dehydrogenation of para-ethyltoluene or diethylbenzene. Furthermore, as persons skilled in the art will well appreciate, the invention may be used advantageously in other situations where a process stream passing through one side of a process heat exchanger is more likely to undergo catalytic reaction due to surface defects or impurities of the heat exchanger surfaces.

What is claimed is:

1. A method of treating the exterior surfaces of the tubes of a shell and tube heat exchanger which are to be contacted by chemicals that interact therewith, said tubes being made of a nickel-containing stainless steel or a chrome iron alloy with a nickel content greater than that of nickel-containing stainless steels, said method comprising the step of:

modifying said exterior surfaces by mechanical grinding or machining so as to eliminate surface defects and thereby render said exterior surfaces less susceptible to attack from said chemicals.

2. Method according to claim 1 wherein said tubes are made of a 300 Series stainless steel.

3. Method according to claim 1 wherein said tubes are made of Incoloy 800 or Incoloy 800H.

4. A method of treating the exterior surfaces of tubes in a shell and tube heat exchanger so as to reduce interaction of said surfaces with selected chemicals in contact therewith, said tubes being made of a nickel-containing stainless steel alloy or a chrome iron alloy with a nickel content greater than that of nickel-containing stainless steels, said method comprising the step of:

removing material from said exterior surfaces by grinding or machining so as to produce a microfinish that renders said exterior surfaces less susceptible to attack from said chemicals.

5. Method according to claim 4 wherein said tubes are made of a chromium-containing alloy.

6. Method according to claim 4 wherein material is removed from said exterior surfaces so as to obliterate or remove all surface blemishes.

7. Method according to claim 4 wherein said exterior surfaces are ground or machined so as produce cold working of said surfaces, whereby said surfaces are substantially free of surface blemishes and have substantially less pronounced grain boundaries.

8. Method according to claim 4 wherein said exterior surfaces have surface impurities or blemishes caused by prior fabrication processes, and said grinding or machining is conducted so as to remove substantially all of said surface impurities and blemishes from said exterior surfaces.

9. Method according to claim 4 wherein said tubes are made of Incoloy 800 or Incoloy 800H.

10. Method according to claim 4 wherein said tubes are made of a 300 Series stainless steel.

11. Method according to claim 10 wherein said tubes are made of 304H stainless steel.

12. Method of treating the external surfaces of the tubes of a shell and tube heat exchanger that are to be contacted by a vapor phase material flowing through the shell side of said heat exchanger, said tubes being made of a nickel-containing stainless steel or a chrome iron alloy with a nickel-containing content greater than that of nickel-containing stainless steels, said vapor phase material being known to have a tendency to interact with said exterior surfaces, said method of treatment comprising the step of:

removing sufficient material from said exterior surfaces by mechanically grinding or machining so as to produce cold working of said exterior surfaces and provide said exterior surfaces with a microfinish that renders said exterior surfaces less susceptible to attack from said vapor phase material.

* * * * *